US006367627B2

(12) United States Patent
Freiborg et al.

(10) Patent No.: US 6,367,627 B2
(45) **Date of Patent: *Apr. 9, 2002**

(54) PACKAGING BOX FOR FOLDED RIDGE COVER ROOFING

(75) Inventors: Mark L. Freiborg, Huntington Beach; Bennie Freiborg, Flintridge, both of CA (US)

(73) Assignee: The Dorothy and Ben Freiborg 1980 Trust, by said Ben Freiborg, Flintridge, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/526,765

(22) Filed: Mar. 16, 2000

(51) Int. Cl.[7] ..... B65D 85/46

(52) U.S. Cl. ..... 206/323; 206/499

(58) Field of Search ..... 206/322, 323, 206/324, 499, 526; 229/120.35, 120.37, 120.36; 53/474, 447

(56) References Cited

U.S. PATENT DOCUMENTS

| | | | | |
|---|---|---|---|---|
| 588,423 | A | * | 8/1897 | Guilbert |
| 2,346,450 | A | * | 4/1944 | Owen ..... 206/323 |
| 3,467,249 | A | * | 9/1969 | Calvert |
| 4,714,643 | A | * | 12/1987 | Kuenzel |
| 5,027,946 | A | * | 7/1991 | Parsons ..... 206/323 |
| 5,615,767 | A | * | 4/1997 | Eull et al. ..... 206/499 |
| 5,651,464 | A | * | 7/1997 | Weber |

* cited by examiner

*Primary Examiner*—David T. Fidei
(74) *Attorney, Agent, or Firm*—Blakely, Sokoloff, Taylor & Zafman LLP

(57) ABSTRACT

A packaging box having a bottom. A supporting insert resting on the bottom of the packaging box. The supporting insert includes a ridge support, a partition panel, and a tab panel. The ridge support includes two support panels. Each support panel has a first side resting against the bottom of the packaging box, and a second side, opposite the first side, joined along a ridge line substantially above the bottom of the packaging box. The partition panel is substantially perpendicular to the bottom of the packaging box. The partition panel has a third side joined to the first side of one of the support panels. The tab panel is at a substantial angle to the partition panel. The tab panel has a first end joined to the partition panel along a line parallel to the ridge line.

30 Claims, 7 Drawing Sheets

PACKAGING BOX FOR FOLDED RIDGE COVER ROOFING

BACKGROUND OF THE INVENTION

1. Field of the Invention

This invention relates to the field of packing boxes, and more particularly to a box with an insert to support folded ridge cover roofing.

2. Prior Art

Various types of roofing and, in particular, ridge covers, are well known in the prior art. One type of ridge cover is a folded asphalt composition ridge cover that has one end folded over to create a thickened end. An exemplary ridge cover of this type is described in patent application Ser. No. 09/433,810.

The ridge cover is fabricated to have approximately the installed shape. It is necessary to avoid unnecessary flexing of the centerline fold, which forms the ridgeline of the ridge cover, during storage and shipping because flexing promotes cracking along the ridgeline. It is desirable to pack the ridge covers in a manner that facilitates easy handling and unpacking of the ridge covers at the rooftop installation site.

SUMMARY OF THE INVENTION

A packaging box having a bottom. A supporting insert resting on the bottom of the packaging box. The supporting insert includes a ridge support, a partition panel, and a tab panel. The ridge support includes two support panels. Each support panel has a first side resting against the bottom of the packaging box, and a second side, opposite the first side, joined along a ridge line substantially above the bottom of the packaging box. The partition panel is substantially perpendicular to the bottom of the packaging box. The partition panel has a third side joined to the first side of one of the support panels. The tab panel is at a substantial angle to the partition panel. The tab panel has a first end joined to the partition panel along a line-parallel to the ridge line.

DETAILED DESCRIPTION OF THE INVENTION

Figure 1:
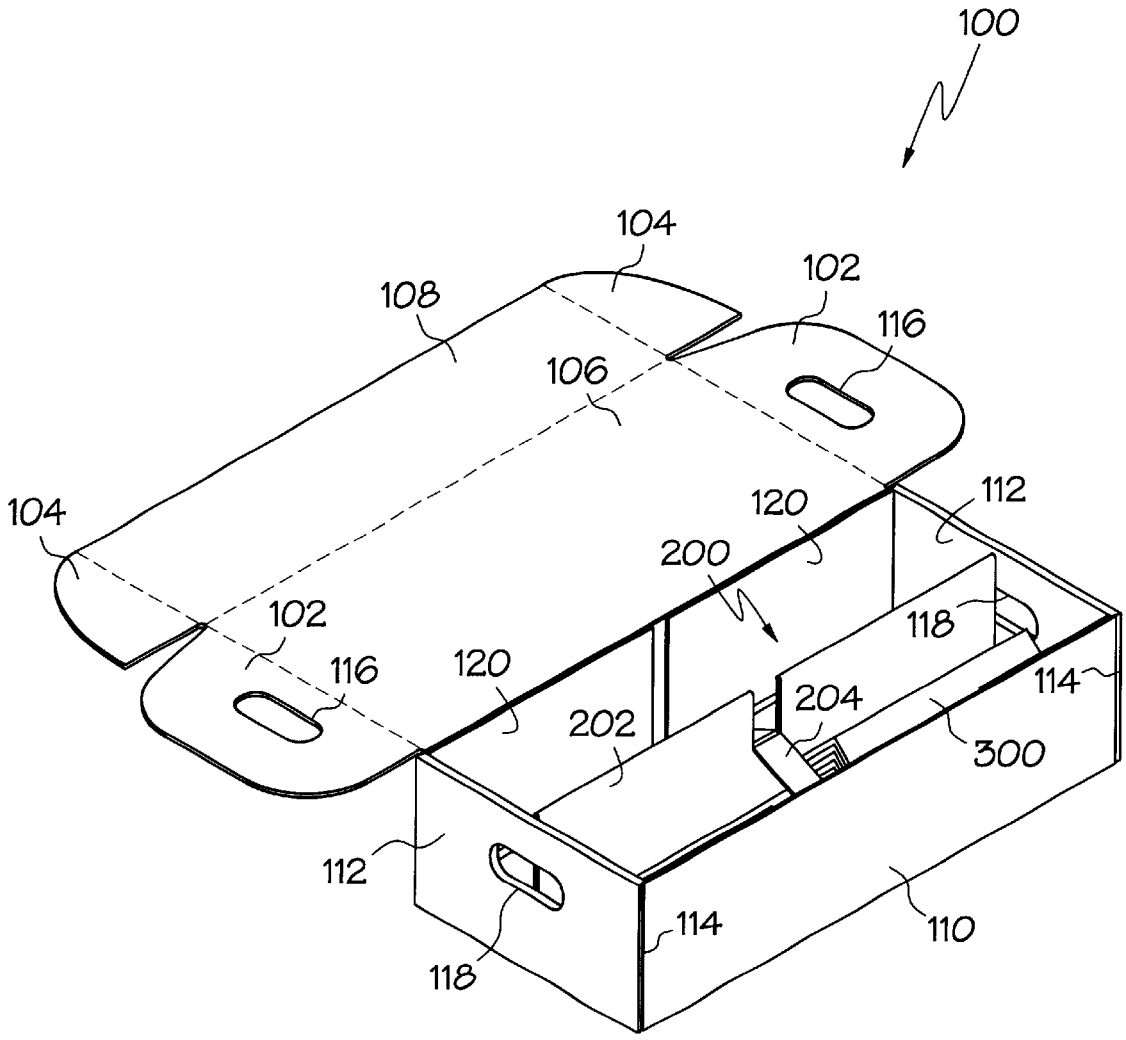
FIG. 1 is a perspective drawing of an embodiment of a packaging box with supporting insert of the present invention partially filled with ridge covers.

FIG. 1 shows an embodiment of a packaging box 100 with a supporting insert 200 according to the present invention.

Figure 2:
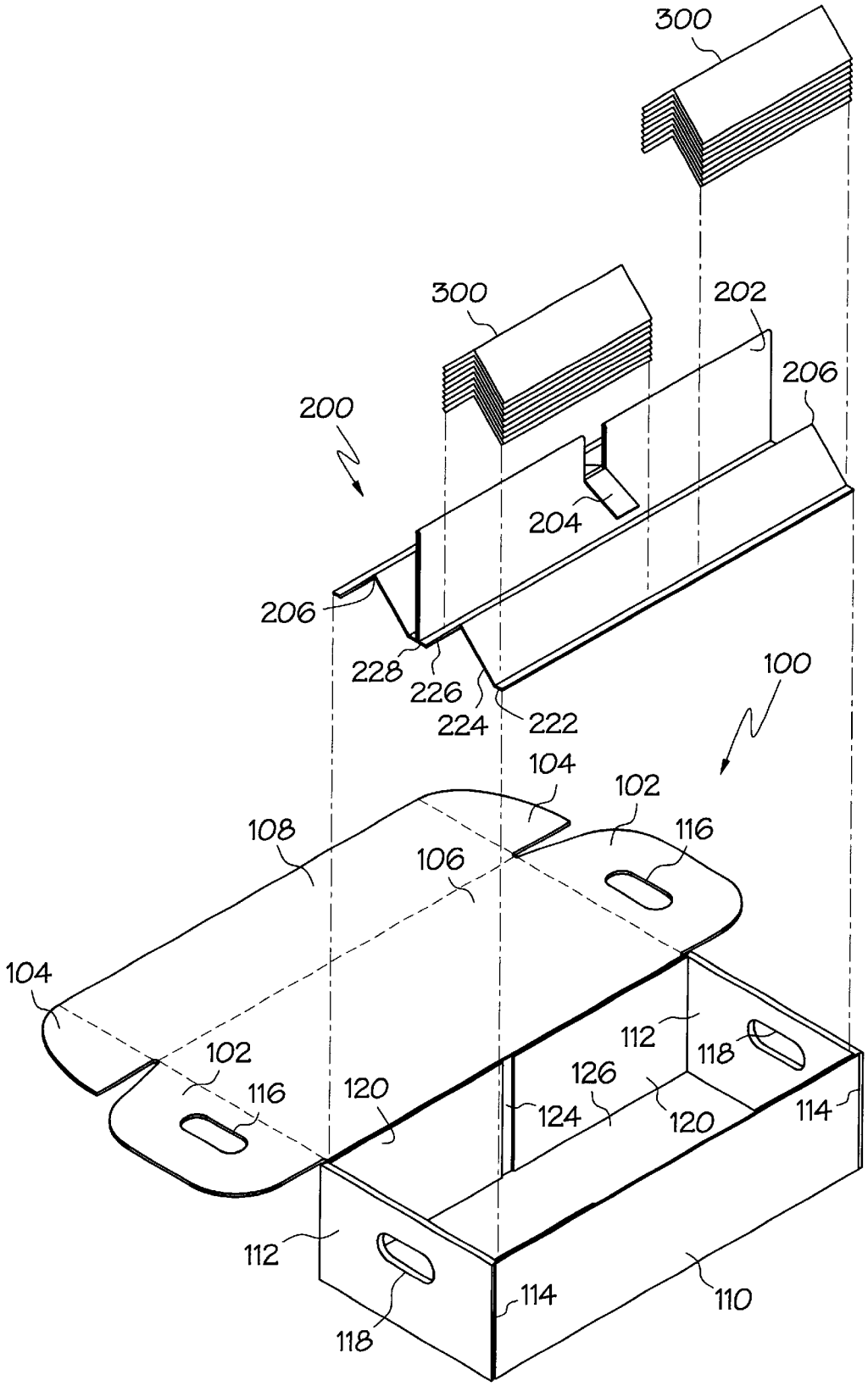
FIG. 2 is an exploded view of the box, insert, and ridge covers shown in FIG. 1.

FIG. 2 is an exploded view that illustrates how the supporting insert 200 is placed in the box 100 and the ridge covers 300 are placed on the insert. This embodiment of the box can receive four stacks of folded ridge cover roofing assemblies. A center partition 202 in the insert separates the stacks of ridge covers side to side. Tab panels 204 in the insert separate the stacks end-to-end. Folded ridge support panels 224, 226 form a ridge line 206 in the insert to support the center of the ridge covers and prevent flattening and cracking of the ridge covers.

When the box 100 has been filled with ridge covers 300, the top flaps 102 and the front flaps 104 of the box lid are folded up. The box lid is then closed over the ridge covers with the box top 106 forming the top of the box and the top flaps 102 inserted inside the box adjacent to the box ends 112. The front panel 108 of the box lid is folded over the front panel 110 of the box and the front flaps 104 are inserted into the locking pockets 114 formed between the box ends and the front panel of the box.

The folding and locking construction of the box provides a box that is strong and rigid. This allows a number of loaded boxes to be safely stacked for storage while supporting the weight of the enclosed ridge covers. The weight is supported by the sides and ends of the box. The enclosed ridge covers do not bear the weight of boxes stacked on top that would tend to flatten and crack the ridge covers.

Hand holes 116 in the top flaps 102 align with hand holes 118 in the box ends 112 when the box is closed. The hand holes allow a loaded box to be easily picked up and moved. When the front flaps 104 are locked into the locking pockets 114, the box lid will resist opening even if the loaded box is tipped or inverted during handling.

Figure 3:
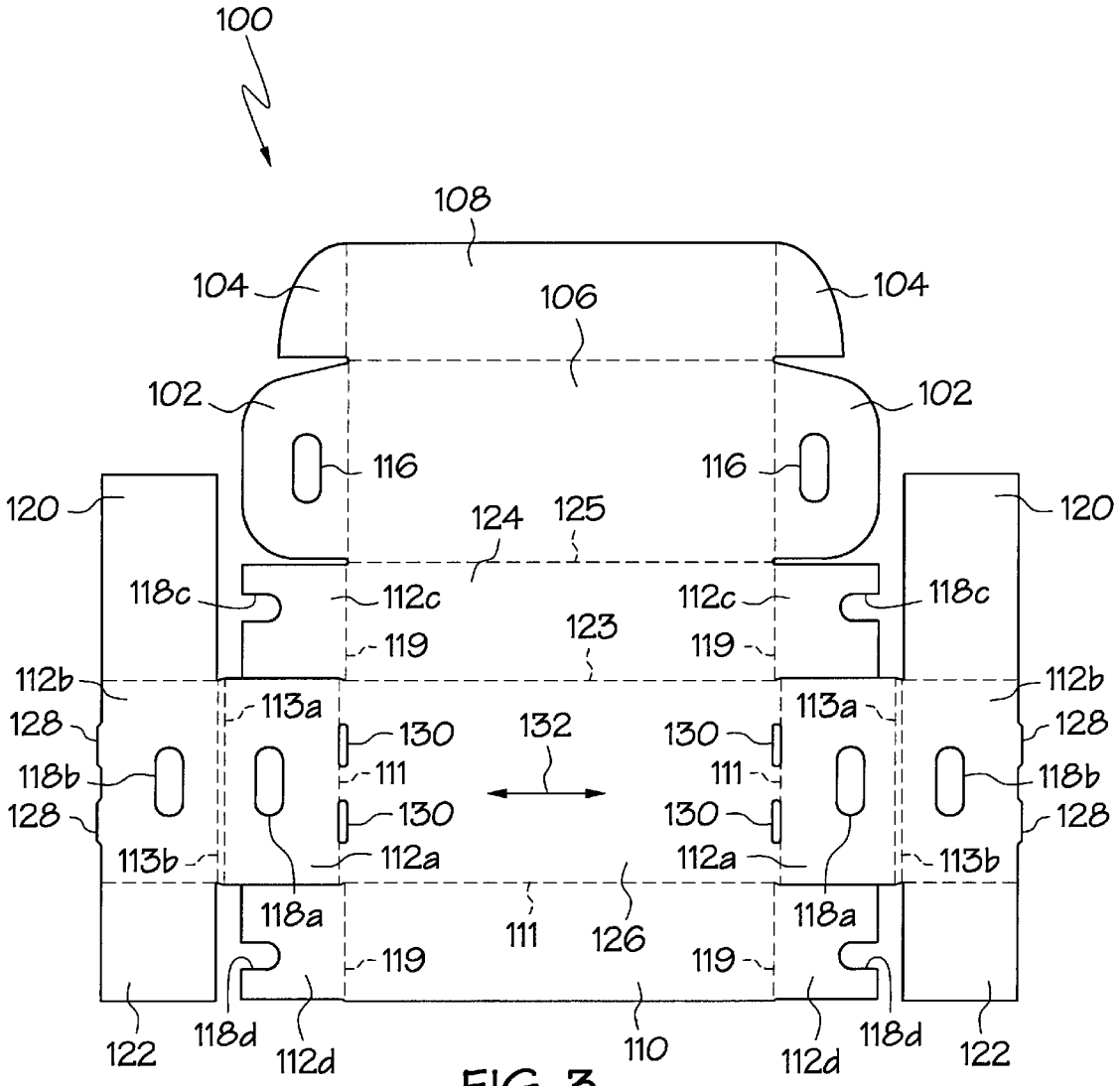
FIG. 3 is a plan view of the packaging box prior to folding.

FIG. 3 shows a plan view of an embodiment of the box 100 before folding. The box preferably is formed from corrugated cardboard with the lines of the corrugation preferably oriented as shown by arrow 132.

Figure 4:
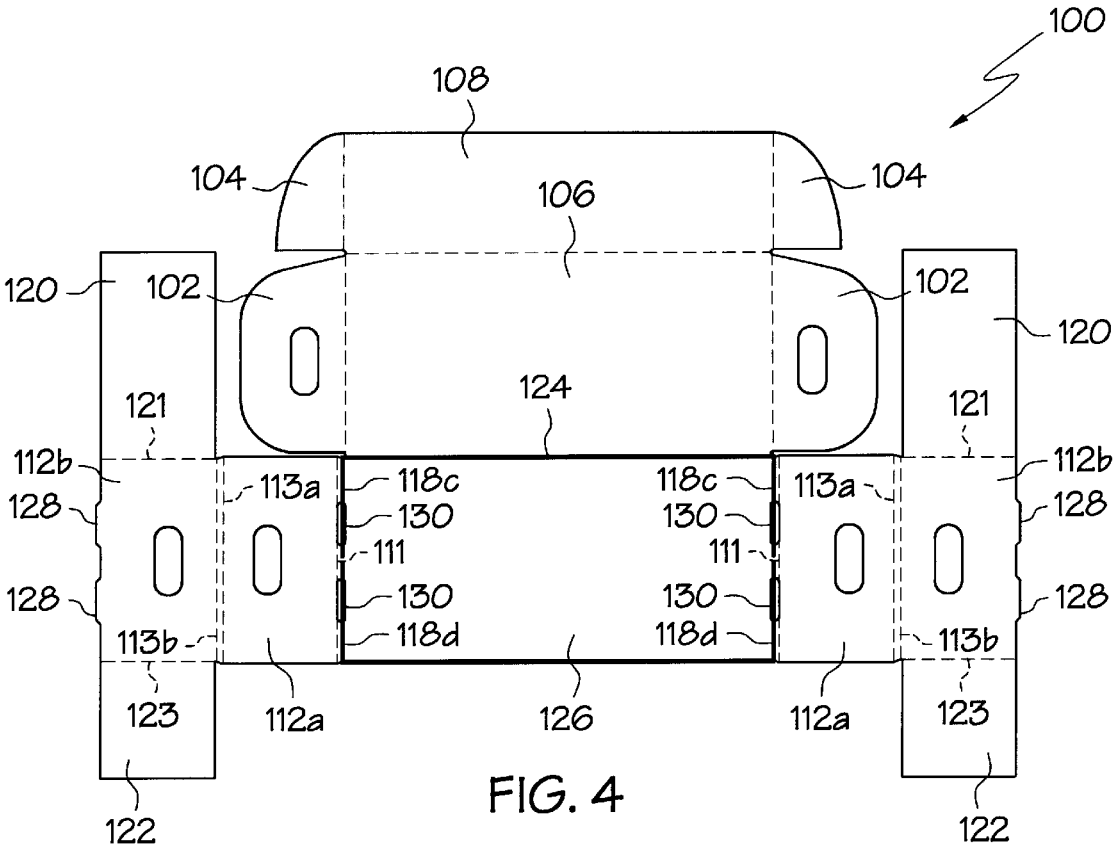
FIG. 4 is a plan view of the packaging box partially folded.

The inner portions of the box end panels 112*c*, 112*d* are folded up along lines 119. The front panel 110 of the box is folded up along line 111 and the back panel 124 of the box is folded up along line 123. The bottom edges of the inner portions of the box end panels now rest against the box bottom 126. FIG. 4 shows a plan view of the box at this stage of folding. The lid portion of the box is shown as being folded back along line 125 although the lid portion could be left unfolded, with the top 106 and front panel 108 and associated flaps 102, 104 in a position perpendicular to that shown.

The outside portions of the box end panels 112*a* are folded up along line 111. Inside front panels 122 and inside back panels 120 are folded away from the box along lines 123 and 121 respectively. The inside portions of the box end panels 112*b* are folded around the inner portions of the box end panels 112*c*, 112*d* and the locking tabs 128 are engaged with the locking slots 130. It may be seen in FIG. 3 that fold line 119 is offset from fold line 111 and a space is provided between fold lines 113*a* and 113*b* so that locking pockets 114 are formed between the inner portions of the box end panels 112*d* and the outside portions of the box end panels 112*a*.

Figure 5:
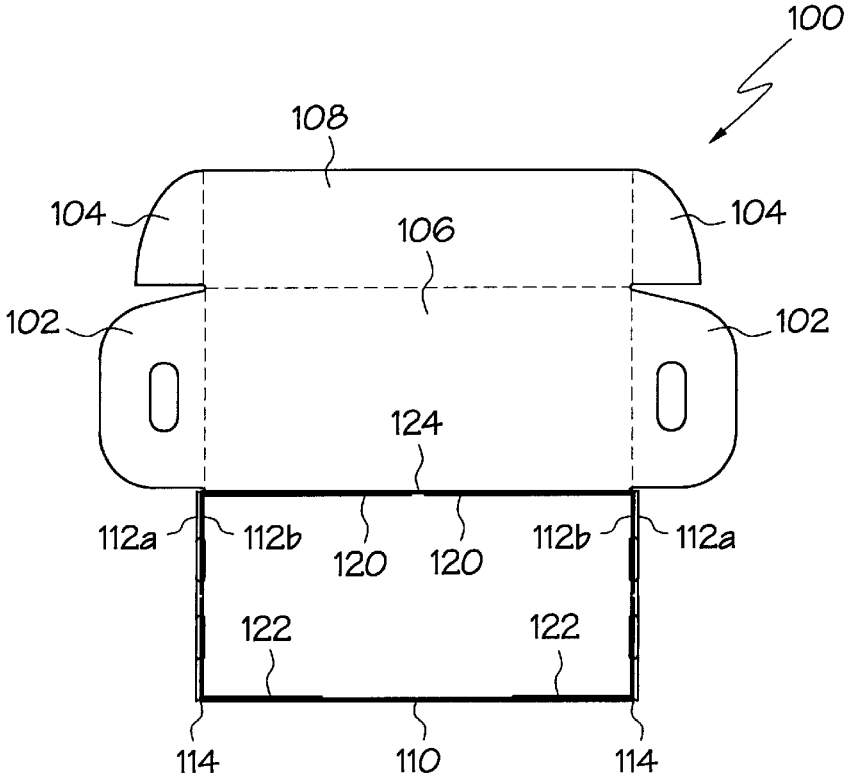
FIG. 5 is a plan view of the packaging box folded to receive the insert and bridge covers.

FIG. 5 shows the box 100 folded and ready to receive the insert 200. The lid portion is again shown as being folded back along line 125. It may be noted that the ends of the box have three thicknesses of cardboard with the corrugations of the inner thickness perpendicular to the corrugations of the outer thicknesses. The back of the box has two thicknesses of cardboard with perpendicular corrugations. The front of the box has two thicknesses of cardboard at the outside ends with perpendicular corrugations. The multi-ply construction of the box sides provides substantial weight bearing capability and allows the loaded boxes to be stacked without crushing the ridges contained in the box.

Figure 6:
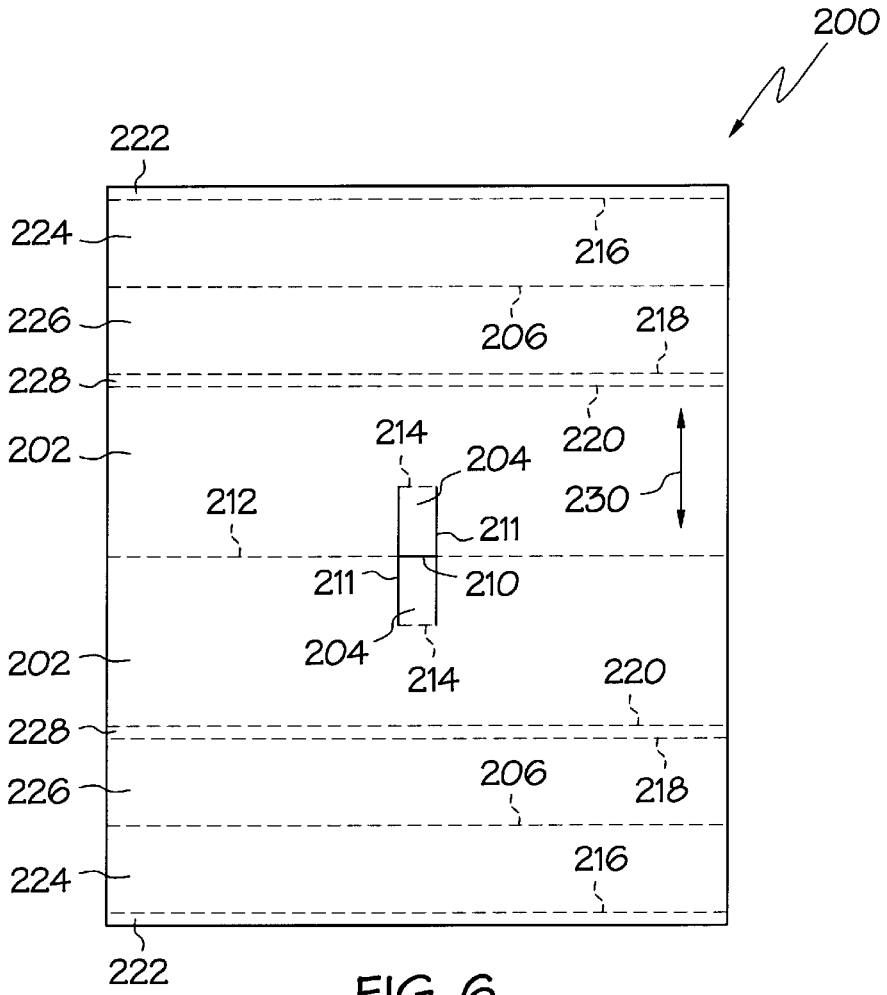
FIG. 6 is a plan view of the supporting insert prior to folding.
Figure 7:
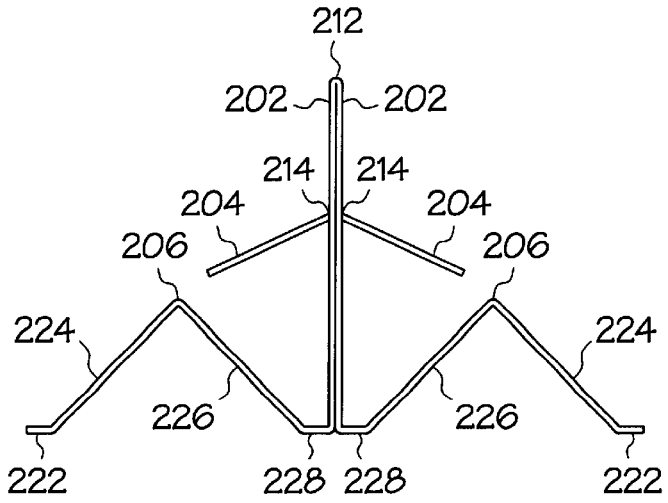
FIG. 7 is an end view of the folded insert.

FIG. 6 shows a plan view of an embodiment of the insert 200 before folding. The insert preferably is formed from corrugated cardboard with the lines of the corrugation preferably oriented as shown by arrow 230. FIG. 7 shows an end view of this embodiment of the folded insert.

The insert 200 is cut along lines 210 and 211 and folded back along lines 214 to form the tab panels 204 that separate the ridge covers 300 end-to-end. The insert is folded along line 212 bringing the two partition panels 202 that form the center partition adjacent to one another. The insert is folded at lines 218 and 220 to form a bottom panel 228 that rests against the bottom of the box. The insert is folded along the ridge line 206 to form a ridge support from the two support panels 224, 226 to support the ridge covers in their formed shape. The insert is folded along line 216 to form another bottom panel 222 that rests against the bottom of the box at the outside edge. The folded insert is placed in the box to receive the ridge covers. The direction of the corrugations in the box bottom 126 are preferably perpendicular to the direction of corrugations in the insert to provide more stiffness to support the ridge covers. It is also preferable that the corrugations of the insert be perpendicular to the ridge line 206 to provide more stiffness in the support panels that support the ridge covers.

Figure 8:
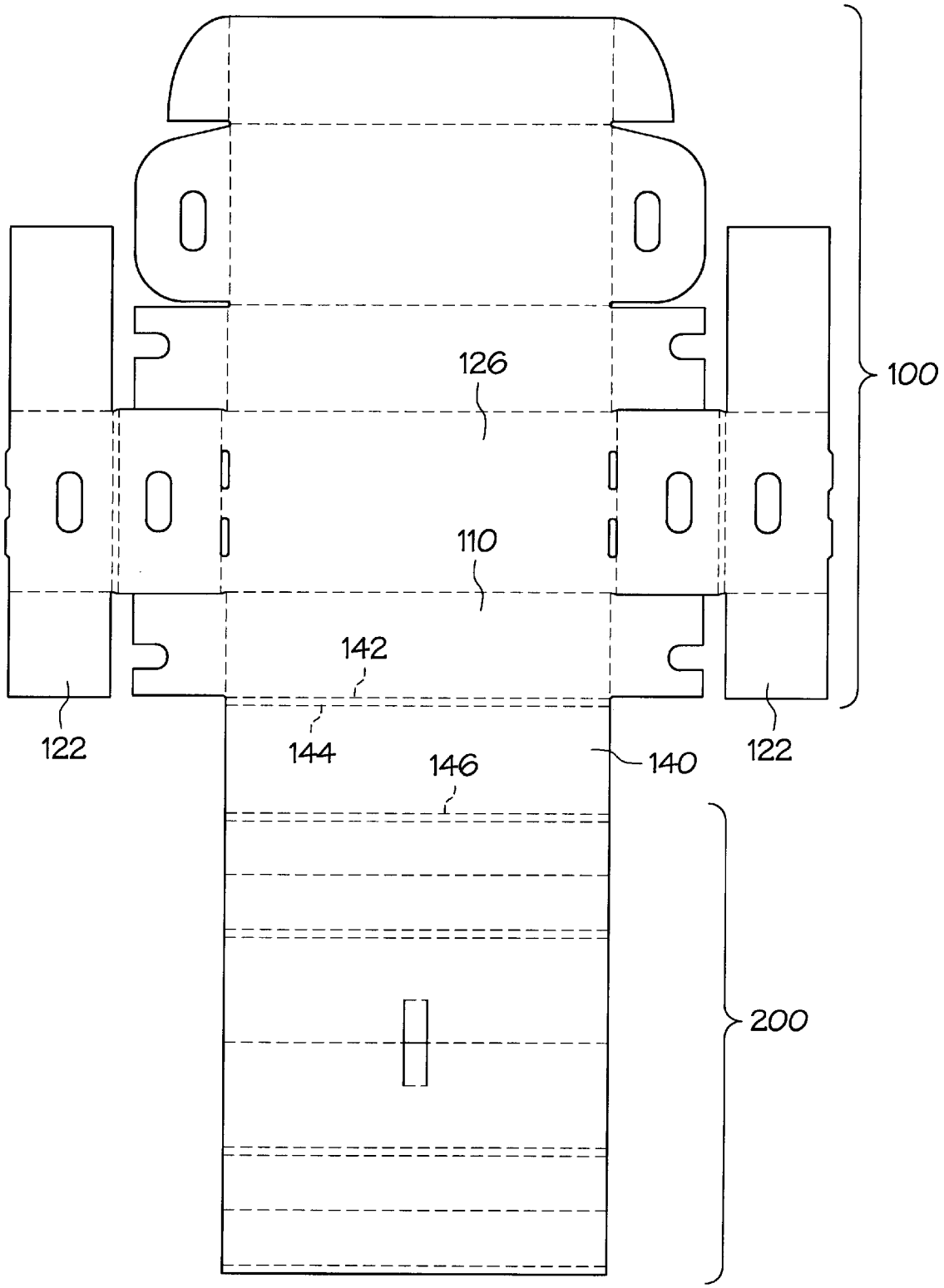
FIG. 8 is a plan view of another embodiment the packaging box and the supporting insert prior to folding.

In an alternate embodiment, shown in FIG. 8, the box 100 and the insert 200 are formed from one piece of material. An additional inner front panel 140 joins the box and the insert. After the box portion has been folded as shown in FIG. 5, the inner front panel 140 is wrapped over the front panel 110 of the box and the inside front panels 122 at fold lines 142 and 144. The insert is folded as previously described and folded away from the inner front panel at fold line 146 to fit the folded insert against the bottom 126 of the box.

Figure 9:
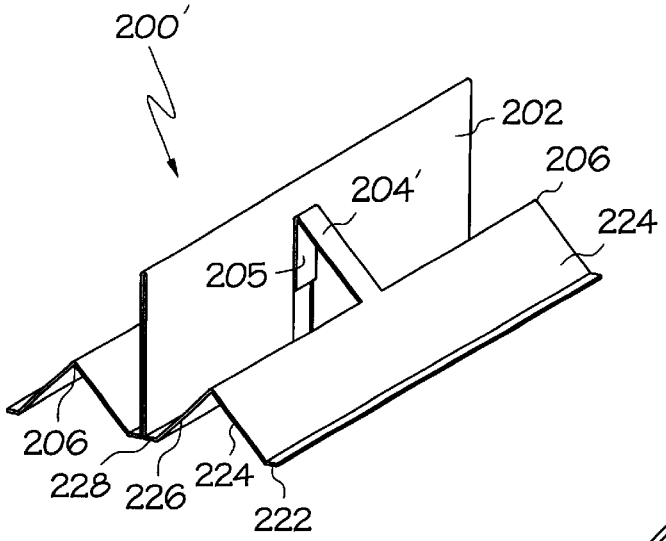
FIG. 9 is a perspective drawing of another embodiment of a supporting insert of the present invention.
Figure 10:
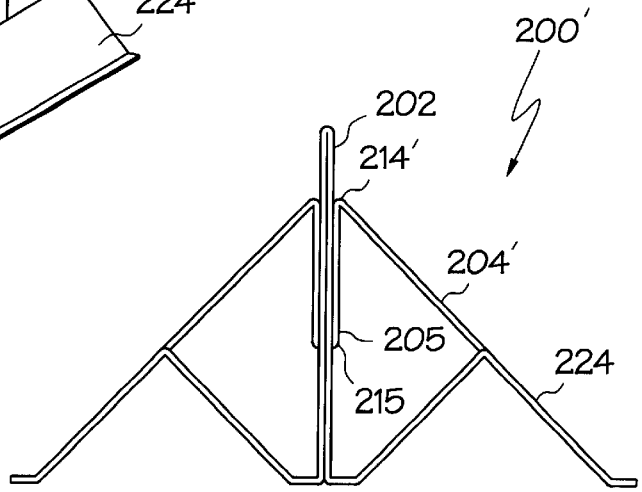
FIG. 10 is an end view of the folded insert of FIG. 9.
Figure 11:
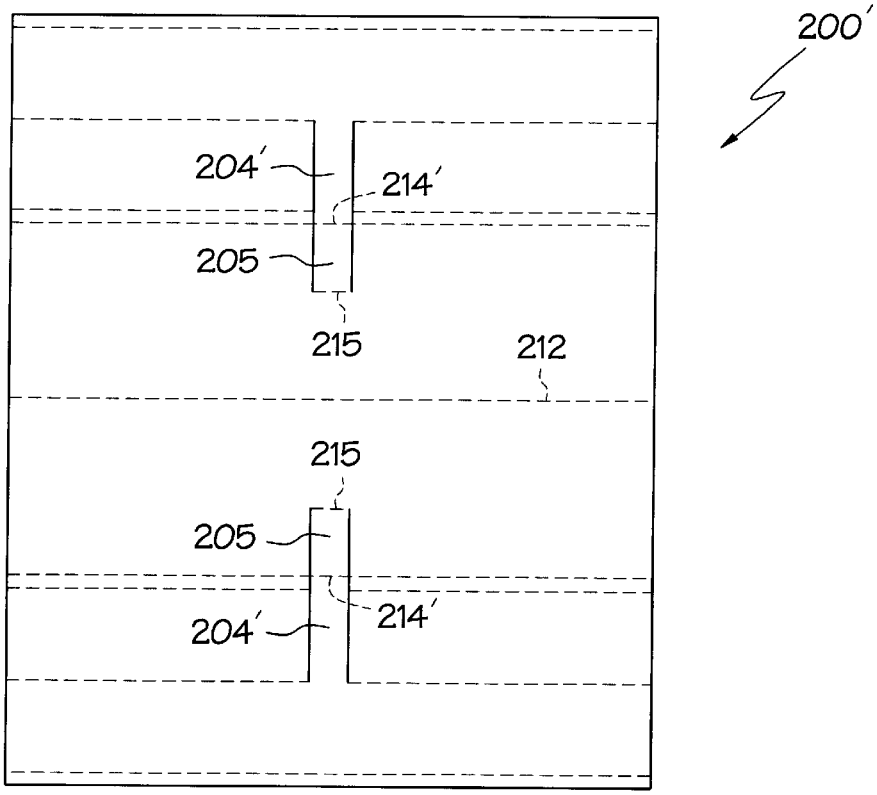
FIG. 11 is a plan view of the supporting insert of FIG. 9 prior to folding.

FIG. 9 shows an alternate embodiment of the supporting insert 200'. FIG. 10 shows an end view and FIG. 11 shows a plan view before folding for this embodiment. In this embodiment the tab panels 204' extend from the outer support panel 224 to the partition 202. A joining panel 205 joins the tab panel to the partition panel at line 214'. The joining panel is connected to the partition panel at line 215. The joining panel is bent back flat against the partition panel to place the connecting edge 214' in the proper location to receive the tab panel.

The ridge covers 300 are substantially thicker at one end than the other. Preferably the ridge covers are stacked with the thick end at alternating ends of the stack so that the stack is substantially level.

In the embodiments shown, the insert supports four stacks in a two by two configuration. It will be appreciated that the insert can be configured in a variety of ways other than two by two. Regardless of the configuration the insert will provide a partition panel 202 between the sides of each pair of adjacent stacks and a tab panel 204 at the end of every stack. The tab panels 204 on the insert provide a space for a roofer to gain a hand hold at one end of the stack to remove the ridge covers for installation.

There has thus been provided a novel packing box and supporting insert for folded ridge cover roofing. While the description of the preferred embodiment has been with specific reference to FIGS. 1–11, it should be understood that various modifications, additions and substitutions may be made to the structure and method of the invention without departing from the spirit and scope of the invention as defined in the appended claims. The material may be corrugated cardboard or any other material that can be formed in the manner required by the design of the box and insert. The box may be of the same or different materials from the insert. The invention is limited only by the appended claims.

What is claimed is:

1. A packaging assembly for folded roofing ridge covers with a fabricated shape approximately the same as an installed shape, the packaging assembly comprising:

a packaging box having
- a bottom,
- four side walls joined to the bottom, and
- a top having
  - a sixth side joined to one of the side walls,
  - two side flaps joined to the top on two edges adjacent to the sixth side, the two side flaps configured to be inserted adjacent to two opposing side walls, and
  - a front panel joined to the top on a seventh side opposite the sixth side with two front flaps joined to the front panel on two edges adjacent to the seventh side, the two front flaps configured to be inserted in two locking pockets in the two opposing side walls,
  - wherein the two opposing side walls and the two side flaps include openings that align cooperatively when the top is closed to provide two hand holes; and a supporting insert resting on the bottom of the packaging box, said supporting insert including
- a ridge support further including two support panels, each support panel having a first side resting against the bottom of the packaging box, and a second side, opposite the first side, joined along a ridge line substantially above the bottom of the packaging box such that the folded roofing ridge covers will be supported in the fabricated shape.

2. A packaging assembly for folded roofing ridge covers with a fabricated shape approximately the same as an installed shape, the packaging assembly comprising:

a packaging box having a bottom; and a supporting insert resting on the bottom of the packaging box, said supporting insert including a ridge support formed from corrugated cardboard, said ridge support further including two support panels, each support panel having a first side resting against the bottom of the packaging box, and a second side, opposite the first side, joined along a ridge line substantially above the bottom of the packaging box, wherein lines of corrugation of said corrugated cardboard are perpendicular to said ridge line, said ridge support such that the folded roofing ridge covers will be supported in the fabricated shape.

3. A packaging assembly for folded roofing ridge covers with a fabricated shape approximately the same as an installed shape, the packaging assembly comprising:

a packaging box having a bottom;

a supporting insert resting on the bottom of the packaging box, said
supporting insert including
- a ridge support further including two support panels, each support panel having a first side resting against the bottom of the packaging box, and a second side, opposite the first side, joined along a ridge line substantially above the bottom of the packaging box such that the folded roofing ridge covers will be supported in the fabricated shape; and a partition panel substantially perpendicular to the bottom of the packaging box, the partition panel having a third side joined to the first side of one of the support panels.

4. The packaging assembly of claim 3 further comprising a tab panel at a substantial angle to the partition panel, the tab panel having a first end joined to the partition panel along a line parallel to the ridge line.

5. The packaging assembly of claim 3 wherein the packaging box further includes four side walls joined to the bottom, and a top having a sixth side joined to one of the side walls.

6. The packaging assembly of claim 5 wherein the top further includes two side flaps joined to the top on two edges adjacent to the sixth side, the two side flaps configured to be inserted adjacent to two opposing side walls, and a front panel joined to the top on a seventh side opposite the sixth side with two front flaps joined the front panel on two edges adjacent to the seventh side, the two front flaps configured to be inserted in two locking pockets in the two opposing side walls.

7. The packaging assembly of claim 4 wherein the line along which the first end of the tab panel is joined to the partition panel is further from the bottom of the packaging box than the ridge line.

8. The packaging assembly of claim 4 wherein the first end of the tab panel is joined to the partition panel by the first end of the tab panel being joined to a third end of a joining panel, a fourth end of the joining panel opposite the third end being joined to the partition panel.

9. The packaging assembly of claim 4 wherein a second end of the tab panel opposite the first end is unconstrained.

10. The packaging assembly of claim 4 wherein a second end of the tab panel opposite the first end is joined to one of the support panels.

11. The packaging assembly of claim 4 wherein a second end of the tab panel opposite the first end is joined to the ridge line.

12. A packaging assembly for folded roofing ridge covers with a fabricated shape approximately the same as an installed shape, the packaging assembly comprising:

a packaging box having a bottom; and a supporting insert resting on the bottom of the packaging box, said supporting insert including a ridge support further including two support panels, each support panel having a first side resting against the bottom of the packaging box, and a second side, opposite the first side, joined along a ridge line substantially above the bottom of the packaging box such that the folded roofing ridge covers will be supported in the fabricated shape, and two bottom panels resting against the bottom of the packaging box, each bottom panel having a fourth side joined to the first side of one of the support panels and a fifth side, opposite the fourth side; and a partition panel substantially perpendicular to the bottom of the packaging box, the partition panel having a third side joined to the fifth side of one of the bottom panels.

13. A packaging assembly for folded roofing ridge covers with a fabricated shape approximately the same as an installed shape, the packaging assembly comprising:

a packaging box having a bottom;

a supporting means for supporting the folded roofing ridge covers in the fabricated shape, the supporting means resting on the bottom of the packaging box; and a partition means for separating adjacent ridge covers, the partition means joined to the supporting means and substantially perpendicular to the bottom of the packaging box.

14. The packaging assembly of claim 13 further comprising a tab means for providing a space between adjacent ridge covers, the tab means joined to the partition means at a substantial angle.

15. The packaging assembly of claim 14 wherein the tab means is further joined to the support means.

16. The packaging assembly of claim 6 wherein the two opposing side walls and the two side flaps include openings that align cooperatively when the top is closed to provide two hand holes.

17. The packaging assembly of claim 3 wherein said supporting insert is formed from corrugated cardboard with lines of corrugation of said corrugated cardboard perpendicular to said ridge line.

18. The packaging assembly of claim 12 wherein the packaging box further includes:

four side walls joined to the bottom, and a top having a sixth side joined to one of the side walls;

four side walls joined to the bottom, and a top having a sixth side joined to one of the side walls, two side flaps joined to the top on two edges adjacent to the sixth side, the two side flaps configured to be inserted adjacent to two opposing side walls, and a front panel joined to the top on a seventh side opposite the sixth side with two front flaps joined to the front panel on two edges adjacent to the seventh side, the two front flaps configured to be inserted in two locking pockets in the two opposing side walls, wherein the two opposing side walls and the two side flaps include openings that align cooperatively when the top is closed to provide two hand holes.

19. The packaging assembly of claim 12 further comprising a tab panel at a substantial angle to the partition panel, the tab panel having a first end joined to the partition panel along a line parallel to the ridge line.

20. The packaging assembly of claim 12 wherein said supporting insert is formed from corrugated cardboard with lines of corrugation of said corrugated cardboard perpendicular to said ridge line.

21. The packaging assembly of claim 2 further comprising a partition panel substantially perpendicular to the bottom of the packaging box, the partition panel having a third side joined to the first side of one of the support panels.

22. The packaging assembly of claim 21 further comprising a tab panel at a substantial angle to the partition panel, the tab panel having a first end joined to the partition panel along a line parallel to the ridge line.

23. The packaging assembly of claim 2 wherein the supporting insert further comprises:

two bottom panels resting against the bottom of the packaging box, each bottom panel having a fourth side joined to the first side of one of the support panels and a fifth side, opposite the fourth side; and a partition panel substantially perpendicular to the bottom of the packaging box, the partition panel having a third side joined to the fifth side of one of the bottom panels.

24. The packaging assembly of claim 23 further comprising a tab panel at a substantial angle to the partition panel, the tab panel having a first end joined to the partition panel along a line parallel to the ridge line.

25. The packaging assembly of claim 2 wherein the packaging box further includes:

four side walls joined to the bottom, and a top having a sixth side joined to one of the side walls;

four side walls joined to the bottom, and a top having a sixth side joined to one of the side walls, two side flaps joined to the top on two edges adjacent to the sixth side, the two side flaps configured to be inserted adjacent to two opposing side walls, and a front panel joined to the top on a seventh side opposite the sixth side with two front flaps joined to the front panel on two edges adjacent to the seventh side, the two front flaps configured to be inserted in two locking pockets in the two opposing side walls, wherein the two opposing side walls and the two side flaps include openings that align cooperatively when the top is closed to provide two hand holes.

26. The packaging assembly of claim 1 further comprising a partition panel substantially perpendicular to the bottom of the packaging box, the partition panel having a third side joined to the first side of one of the support panels.

27. The packaging assembly of claim 26 further comprising a tab panel at a substantial angle to the partition panel, the tab panel having a first end joined to the partition panel along a line parallel to the ridge line.

28. The packaging assembly of claim 1 wherein the supporting insert further comprises:

two bottom panels resting against the bottom of the packaging box, each bottom panel having a fourth side joined to the first side of one of the support panels and a fifth side, opposite the fourth side; and a partition panel substantially perpendicular to the bottom of the packaging box, the partition panel having a third side joined to the fifth side of one of the bottom panels.

29. The packaging assembly of claim 28 further comprising a tab panel at a substantial angle to the partition panel, the tab panel having a first end joined to the partition panel along a line parallel to the ridge line.

30. The packaging assembly of claim 1 wherein said supporting insert is formed from corrugated cardboard with lines of corrugation of said corrugated cardboard perpendicular to said ridge line.

* * * * *